US005659225A

United States Patent [19]

Tsuruoka et al.

[11] Patent Number: 5,659,225

[45] Date of Patent: Aug. 19, 1997

[54] COLOR CATHODE RAY TUBE WITH IMPROVED MAIN LENS

[75] Inventors: Atsushi Tsuruoka, Onjuku-machi; Masayoshi Misono, Chiba-ken, both of Japan

[73] Assignees: Hitachi, Ltd., Tokyo; Hitachi Device Engineering Co., Ltd., Mobara, both of Japan

[21] Appl. No.: 309,153

[22] Filed: Sep. 20, 1994

[30] Foreign Application Priority Data

Sep. 20, 1993 [JP] Japan ..... 5-233184

[51] Int. Cl.[6] ..... H01J 29/50

[52] U.S. Cl. ..... 313/414; 315/5.12

[58] Field of Search ..... 313/414; 315/5.14, 315/5.12, 5.15

[56] References Cited

U.S. PATENT DOCUMENTS

| | | | |
|---|---|---|---|
| 4,656,391 | 4/1987 | Say | 313/414 |
| 4,812,706 | 3/1989 | Baudry et al. | 313/414 |
| 4,833,365 | 5/1989 | Shirai et al. | 313/414 |
| 4,922,166 | 5/1990 | Ichida et al. | 313/414 |
| 5,038,073 | 8/1991 | Son | 313/414 |
| 5,146,133 | 9/1992 | Shirai et al. | 313/414 |
| 5,212,423 | 5/1993 | Noguchi et al. | 313/414 |
| 5,291,093 | 3/1994 | Lee | 313/414 |
| 5,394,053 | 2/1995 | Yun | 313/414 |

*Primary Examiner*—Alvin E. Oberley
*Assistant Examiner*—Lawrence O. Richardson
*Attorney, Agent, or Firm*—Antonelli, Terry, Stout & Kraus, LLP

[57] ABSTRACT

A color cathode ray tube includes a vacuum envelope including a panel portion, a neck portion accommodating an electron gun, and a funnel portion connecting the panel portion and the neck portion, and aperture electrodes having apertures for passing center and side electron beams, respectively, located in a main lens electrode including two opposing cylindrical electrodes having racetrack-shaped sections. At least one of the apertures is not circular. The apertures of at least one aperture electrode for the center electron beam and for the side electron beams are displaced with respect to each other to provide a step in the direction in which the electron beams pass.

23 Claims, 6 Drawing Sheets

COLOR CATHODE RAY TUBE WITH IMPROVED MAIN LENS

BACKGROUND OF THE INVENTION

1. Field of the Invention

The present invention relates to a cathode ray tube and, more particularly, to a color cathode ray tube equipped with an in-line electron gun having improved focusing characteristics.

2. Description of the Prior Art

A color cathode ray tube for displaying a color image in a TV receiver or a color monitor has a vacuum envelope composed of a panel portion serving as a picture screen, a neck portion for accommodating an electron gun, and a funnel portion connecting the panel portion and the neck portion. The funnel portion is equipped with a deflection yoke for scanning an electron beam emitted from the electron gun horizontally and vertically over a phosphor layer on the inner face of the panel portion.

FIG. 1 is a sectional view for explaining the entire structure of the color cathode ray tube of this kind. Reference numeral 1 designates a panel portion, numeral 2 a neck portion, numeral 3 a funnel portion, numeral 4 a phosphor layer, numeral 5 a shadow mask, numeral 6 a mask frame, numeral 7 a magnetic shield, numeral 8 a spring suspension mechanism, numeral 9 an electron gun, numeral 10 a deflection yoke, and numerals 11, 12 and 13 magnets for beam-centering corrections or color purity correction.

In the structure shown, the electron gun 9 accommodated in the neck portion 2 includes a cathode, a control electrode, focusing electrodes and accelerating electrodes. The electron gun 9 thus constructed modulates the electron beam from the cathode with video signals and causes the modulated electron beam to impinge upon the aforementioned phosphor layer 4 with a desired sectional shape and energy applied to it through the focusing electrodes and accelerating electrodes which constitute a main lens.

Electron beams Bc (center beam) and Bs (side beams) are horizontally and vertically deflected in their paths from the electron gun 9 to the phosphor layer 4 by the deflection yoke 10 mounted on the funnel portion 3.

FIG. 2 is a side elevation view for explaining the electrode construction of the electron gun accommodated in the neck portion of the color cathode ray tube shown in FIG. 1. Reference numeral 91 designates a first grid electrode, numeral 92 a second grid electrode, numeral 93 a third grid electrode, numeral 94 a fourth grid electrode, numeral 95 a shield cup, numeral 96 a bead glass, numeral 97 a stem, and letter K a cathode electrode.

As shown, the electron gun is constructed by arranging the aforementioned cathode electrode K, first grid electrode 91, second grid electrode 92, third grid electrode 93 and fourth grid electrode 94 in the recited order and embedding these electrodes fixedly in the bead glass 96 made of an insulating glass material with predetermined spacings between the electrodes and these individual electrodes are impressed with voltages through the stem 97 or a contact spring which is mounted in the shield cup 95.

FIG. 3 is a sectional view showing an essential portion for explaining the electrode structure of the main lens portion of the aforementioned electron gun in more detail. The same reference numerals as those of FIG. 2 designate the identical portions. Reference numeral 93-1 designates an aperture electrode disposed in the third grid electrode 93 (i.e., a beam-entrance-side electrode of the main lens), and numeral 94-1 designates an aperture electrode which is disposed in the fourth grid electrode 94 (i.e., a beam-exit-side electrode of the main lens). The opposing electrodes constituting the main lens portion (i.e., the third grid electrode 93 and the fourth grid electrode 94) are made of cylindrical electrodes having a racetrack-shaped section with its major axis being in the inline direction of the three electron beams.

FIG. 4 is an enlarged sectional view of the fourth grid electrode, and FIG. 5 is an enlarged front elevation view showing the fourth grid electrode. Reference numeral **94*a* designates an aperture for the center electron beam, numeral 94*b* apertures for the side electron beams, numeral 94-2 edges of the side electron beam apertures, and numeral 94-3** edges of the center electron beam aperture (as shown in U.S. Pat. No. 4,599,534, for example).

As shown, the fourth grid electrode 94 of the prior art is made of a cylindrical electrode having a racetrack-shaped section so that it is rotationally asymmetric (i.e., non-circular). This results in a difference in the focusing characteristics between the center electron beam and the side electron beams.

If the electrodes of the main lens portion are thus rotationally asymmetric, the main lens for the center electron beam and the main lens for the side electron beams fail to have equal characteristics. For example, the focusing voltage for the side electron beams becomes lower than that for the center electron beam. If the focusing voltage is adjusted for optimum focus of the side electron beams, the spot diameter of the center electron beam becomes larger than that of the side electron beams.

In order to obtain equal characteristics in the main lenses for the center electron beam and for the side electron beams, the focusing characteristics are improved by optimizing the shapes of the apertures of the aperture electrodes 93-1 and 94-1 inserted in the cup-shaped electrode constituting the main lens portion shown in FIG. 3.

The shapes of the apertures of the aperture electrodes 93-1 and 94-2 can be designed independently of each other for the center electron beam and the side electron beams so that the electric fields of the main lenses for the center electron beam and the side electron beams can be controlled substantially independently of each other.

In FIG. 3, the spacing (i.e., dimension S) between the electron beams is usually about 5.5 mm. As a result, it is difficult to make the focusing characteristics of the main lens for the center electron beam match those of the main lens for the side electron beams and to retain keeping the overall focusing characteristics of the main lenses sufficiently at the same time.

SUMMARY OF THE INVENTION

An object of the present invention is to solve the aforementioned problems of the prior art and to provide a color cathode ray tube which can display a picture of high resolution by making the focusing characteristics of the main lenses for the center electron beam and for the side electron beams match each other and by retaining the focusing characteristics of the main lens for the side electron beams at the same time.

One of the factors for determining the focusing characteristics of the main lenses is a dimension d, as shown in FIG. 4. This dimension d is an axial distance from the end portion at the electron-beam-entrance side of the electron-beam-exit-side electrode to the aperture electrode. The larger the dimension d is, the larger the equivlent aperture; diameter of the main lens becomes.

In the main lenses of the prior art, the dimension d is the same in the main lens portion for the center electron beam and in the main lens portions for the side electron beams.

Therefore, the equivalent aperture diameter of the center main lens portion for the center electron beam can be enlarged by making the dimension d of the main lens portion larger for the center electron beam than that of the main lens portions for the side electron beams.

In order to achieve the above-specified object, according to the present invention, there is provided a color cathode ray tube which includes a vacuum envelope including a panel portion, a neck portion accommodating an electron gun, and a funnel portion connecting the panel portion and the neck portion, and aperture electrodes for constituting main lenses for the electron gun, beam-passing aperture electrodes inserted in two opposing cylindrical electrodes having racetrack-shaped sections, at least one of which beam-passing apertures is not circular, for passing a center electron beam and side electron beams, respectively, therethrough. The apertures for the center electron beam and for the side electron beams of at least one aperture electrode are displaced with respect to each other to provide a step between the planes containing the apertures in the direction in which the electron beams pass.

In the aforementioned construction of the present invention, the dimension d of the aperture electrode for the center electron beam aperture is made larger than the dimension d for the side electron beam apertures so that the equivalent aperture diameters of the main lenses for the side electron beams and the center electron beam can be equalized. As a result, the focusing characteristics of the side electron beams and the center electron beam can match each other to provide a color cathode ray tube having an excellent resolution display.

DETAILED DESCRIPTION OF THE PREFERRED EMBODIMENTS

The present invention will be described in detail in connection with its embodiments with reference to the accompanying drawings.

Figure 6:
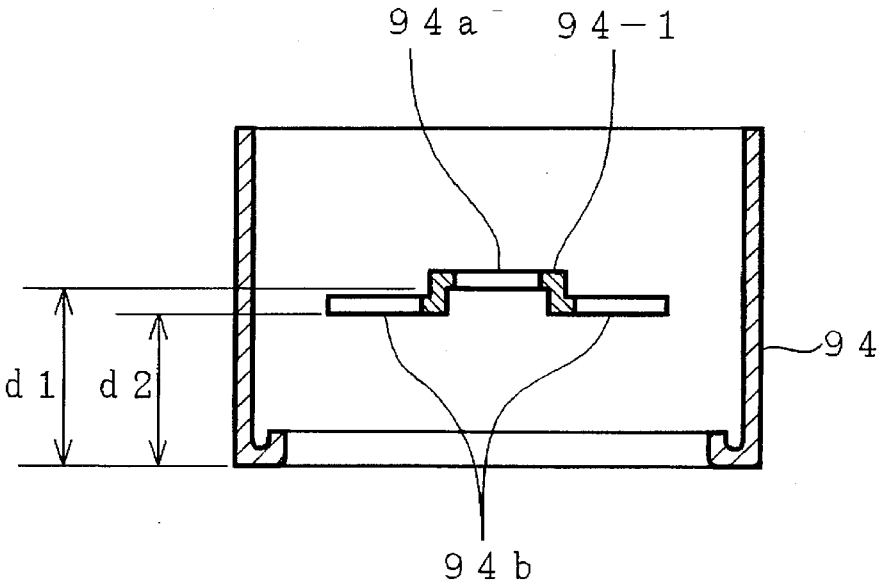
FIG. 6 is a sectional view for explaining an embodiment of an electron-beam-exit-side electrode of a main lens electrode of the electron gun of a color cathode ray tube according to the present invention.

FIG. 6 is a sectional view for explaining one embodiment of an electron-beam-exit-side electrode of a main lens electrode of the electron gun of a color cathode ray tube according to the present invention. An aperture electrode 94-1 is disposed in an electron-beam-exit-side electrode 94 having a racetrack-shaped section such that an aperture for the center electron beam has a larger dimension $d_1$ than the dimension $d_2$ of the apertures for the side electron beams.

Figure 1:
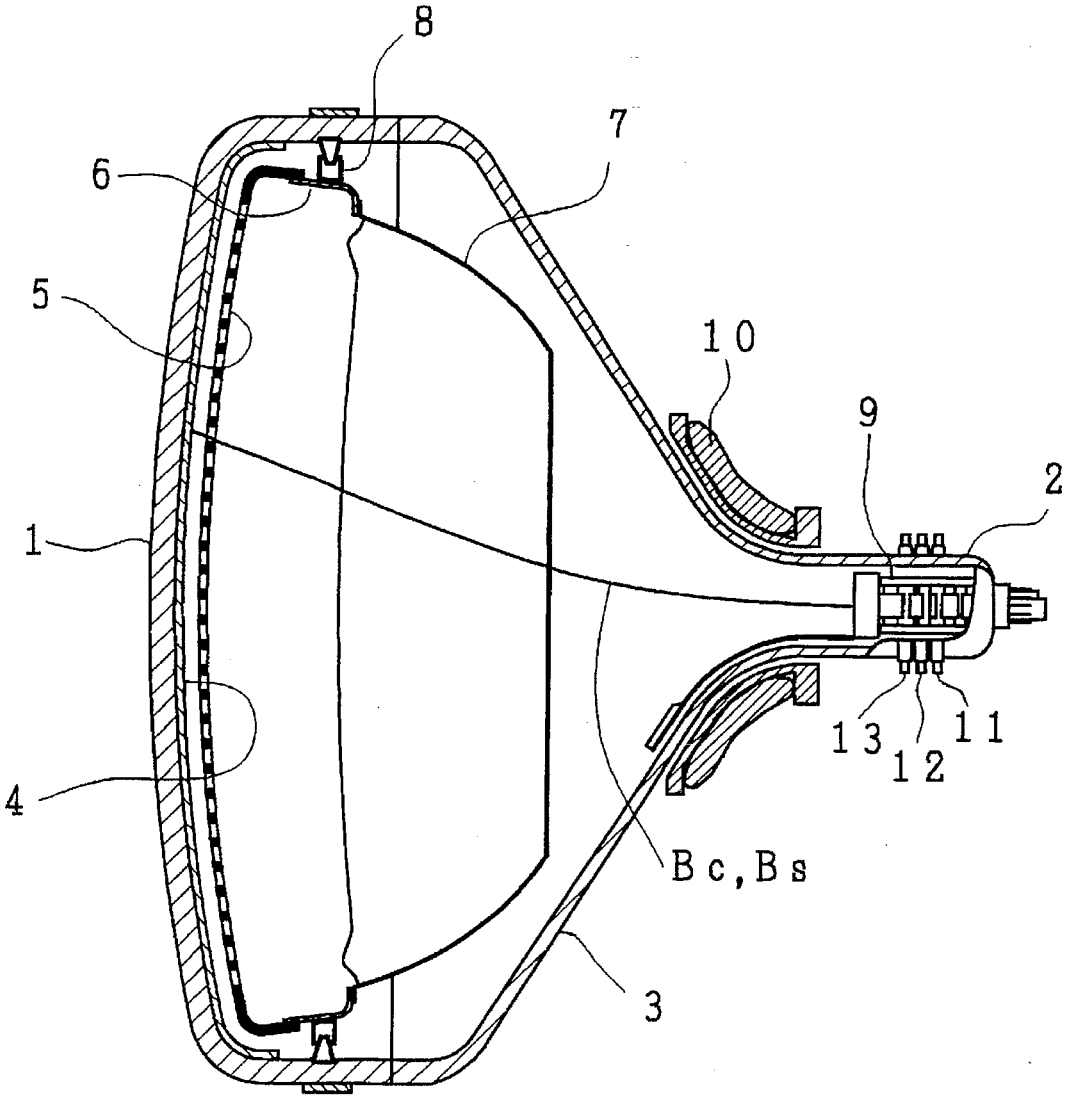
FIG. 1 is a sectional view for explaining the entire structure of a color cathode ray tube according to the present invention.
Figure 2:
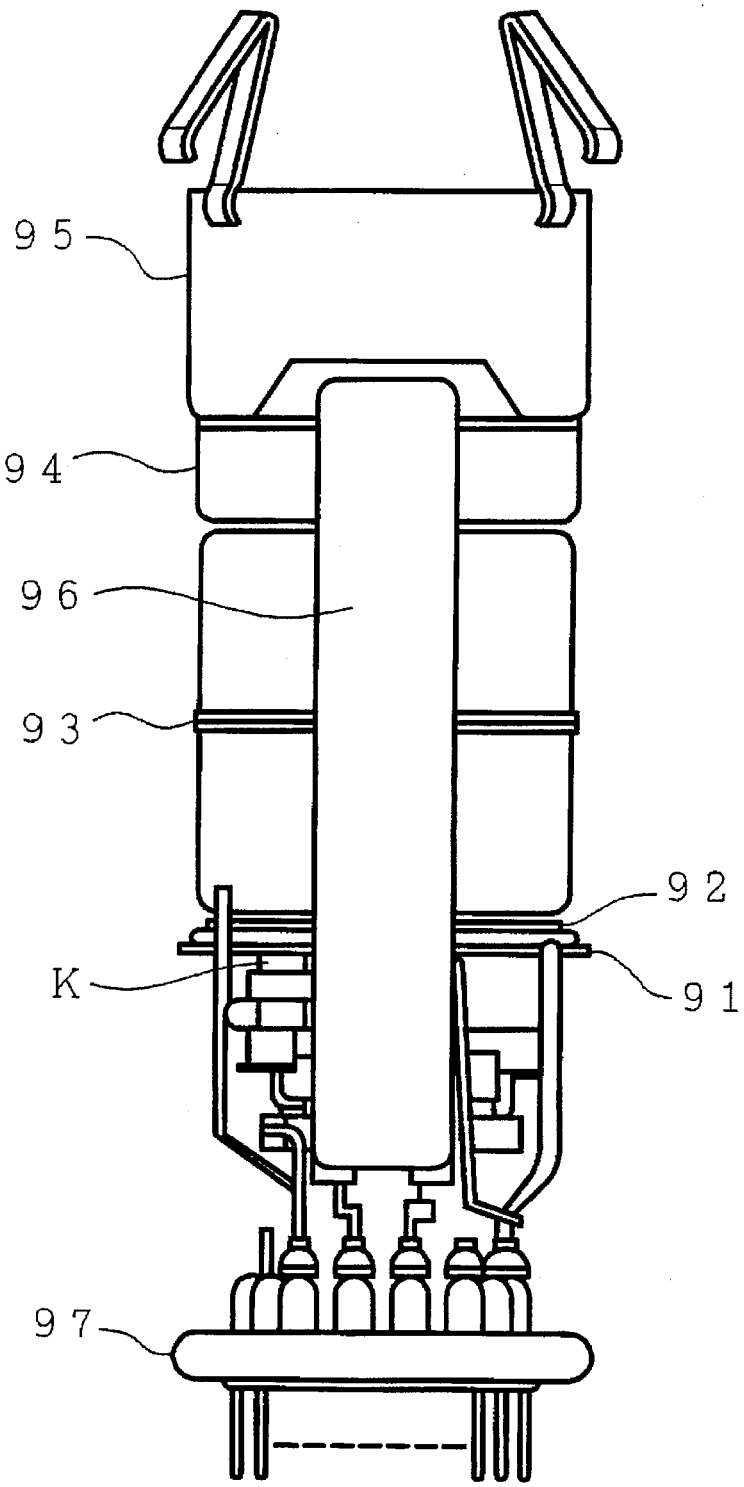
FIG. 2 is a side elevation view for explaining the electrode construction of an electron gun to be accommodated in the neck portion of the color cathode ray tube shown in FIG. 1.
Figure 3:
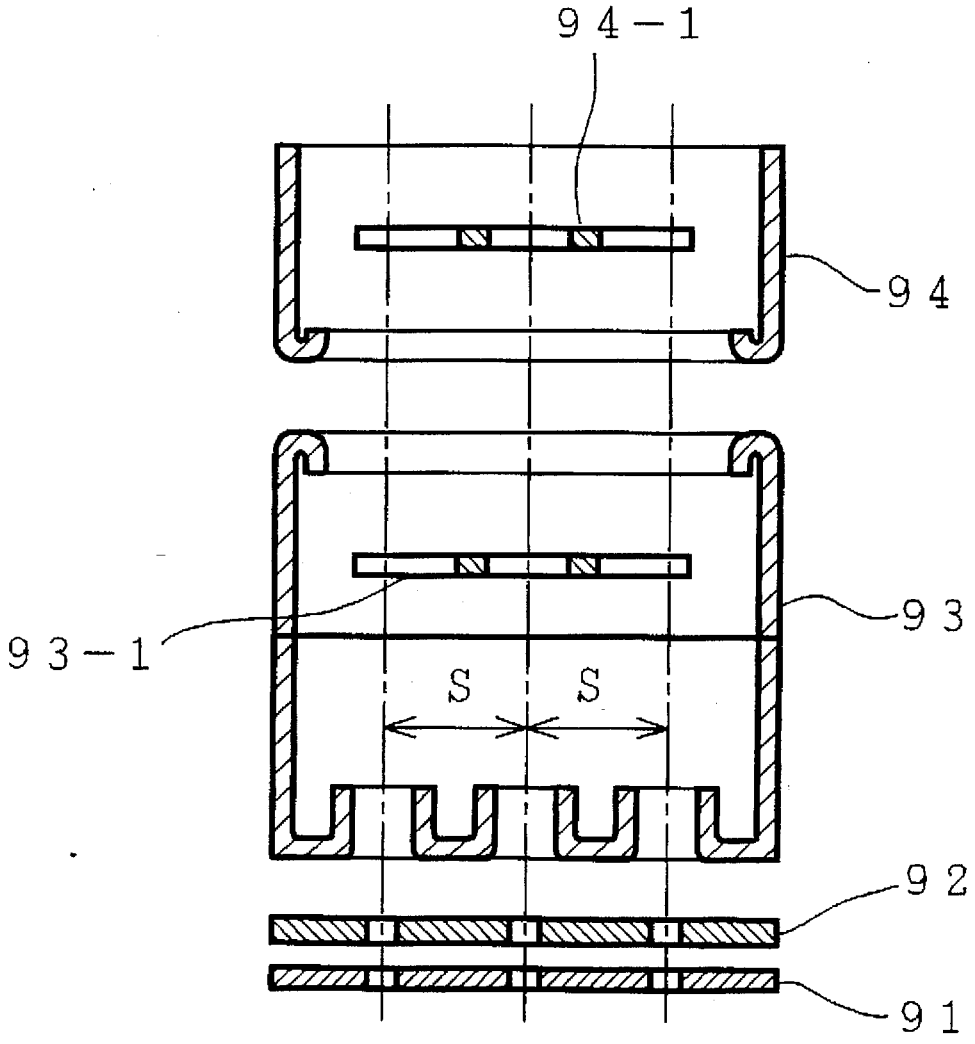
FIG. 3 (PRIOR ART)
FIG. 3; is a sectional view showing an essential portion for explaining the electrode structure of the main lens portion of electron gun of the prior art in detail.
Figure 4:
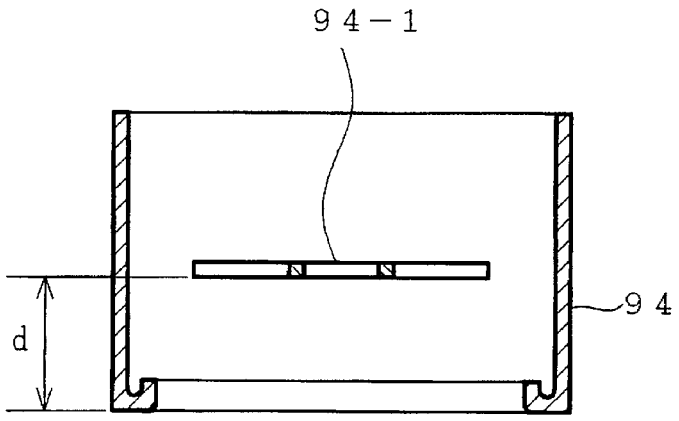
FIG. 4 (PRIOR ART)
FIG. 4 is an enlarged sectional view showing a fourth grid electrode of the main lens portion of the electron gun of the prior art.
Figure 5:
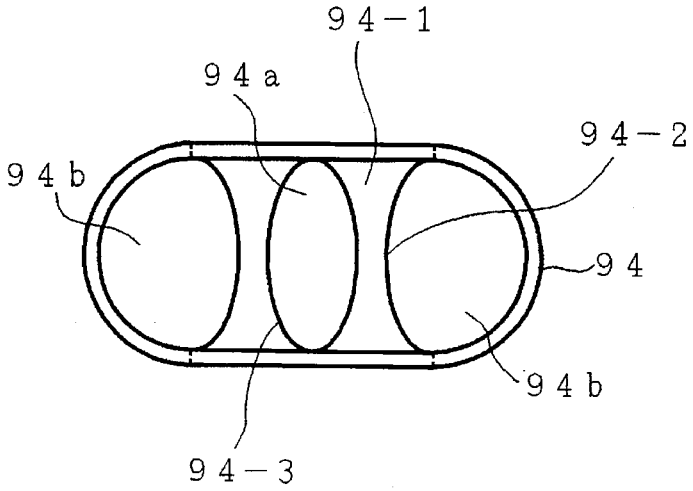
FIG. 5 (PRIOR ART)
FIG. 5 is an enlarged front elevation view showing the fourth grid electrode of FIG. 3.

In other words, the aperture of the aperture electrode for the center electron beam is located at a higher position than those for the side electron beams, as viewed from the cathode side end portion of the electrode (e.g., the electron-beam-exit-side electrode such as the fourth grid electrode in FIG. 2) of the main lens. As a result, the equivalent aperture diameter of the main lens at the aperture for the center electron beam is enlarged to the equivalent aperture diameter of the main lens at the apertures for the side electron beams so that their focusing characteristics are substantially equalized.

Figure 7:
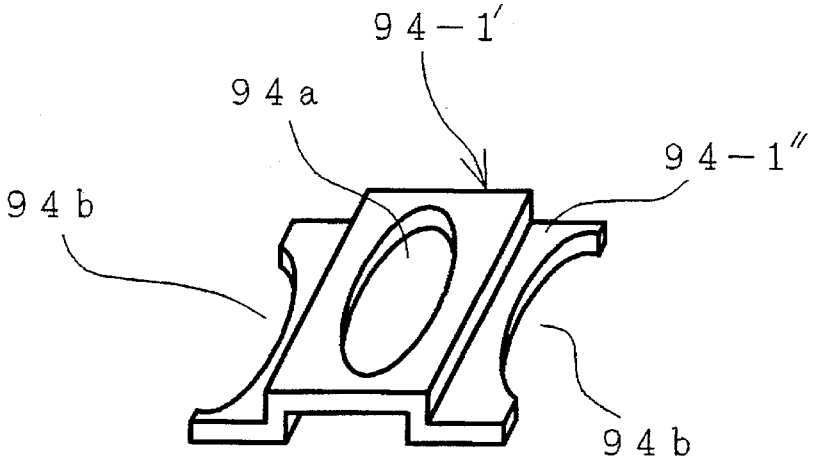
FIG. 7 is a perspective view showing an aperture electrode to be inserted in the main lens electrode of the electron gun of the color cathode ray tube according to the present invention.

FIG. 7 is a perspective view of the aperture electrode. In an aperture **94*a* for the center electron beam, a portion 94-1" is located at a higher level than that of the portions 94-1" of the apertures 94*b*** for the side electron beams.

Figure 8:
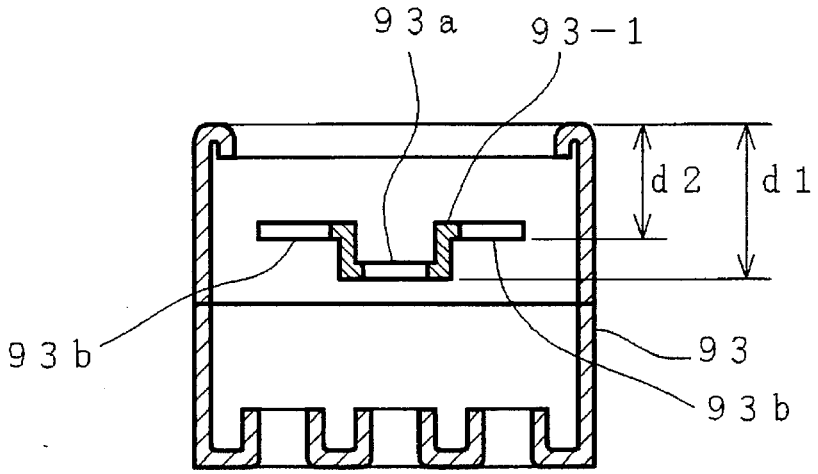
FIG. 8 is a sectional view for explaining an embodiment of an electron-beam-entrance-side electrode of the main lens electrode of the electron gun of a color cathode ray tube according to the present invention.

FIG. 8 is a sectional view for explaining another embodiment of a main lens electrode of the electron gun of the color cathode ray tube according to the present invention. An aperture electrode 93-1 is disposed in an electron-beam-entrance-side cylindrical electrode 93 having a racetrack-shaped section such that the dimension $d_1$ of its center electron beam aperture portion is made larger than the dimension $d_2$ of its side electron beam aperture portions. In other words, in the aperture electrode 93-1 disposed in the electrode 93 (e.g., the third grid electrode of FIG. 2), the aperture **93*a* for the center electron beam is located at a lower level than that of the apertures 93*b* for the side electron beams by displacing the aperture 93*a*** from the electron-beam-exit-side end portion toward the cathode.

By this construction, too, the equivalent aperture diameter of the main lens at the center electron beam aperture is enlarged and equalized, as in the foregoing embodiment, to that of the main lens at the side electron beam apertures so that their focusing characteristics are substantially equalized.

Figure 9:
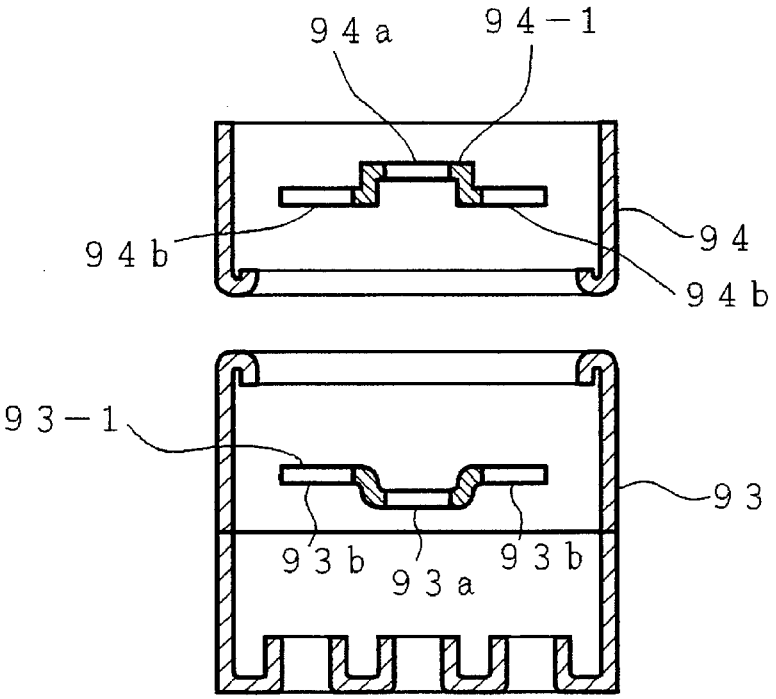
FIG. 9 is a sectional view for explaining an embodiment of an electron-beam-entrance-side electrode and an electron-beam-exit-side electrode. of the main lens electrode of the electron gun of a color cathode ray tube according to the present invention.

FIG. 9 is a sectional view for explaining still another embodiment of a main lens electrode of the electron gun of the color cathode ray tube according to the present invention. This embodiment is a combination of the constructions of the foregoing embodiments of FIGS. 6 and 8.

Specifically, the aperture of the aperture electrode for the center electron beam is located at a higher position than those for the side electron beams, as viewed from the cathode side end portion of the electrode 94 constituting the main lens. At the same time, the aperture electrode 93-1 disposed in the electrode 93 has its center electron beam aperture **93*a* displaced toward the cathode from the electron-beam-exit-side end portion so that the aperture 93*a* is lower than that of the side electron beam apertures 93*b***.

According to this construction, the aperture electrodes 93-1 and 94-1 disposed in the electrodes 93 and 94, respectively, can have their individual center electron beam apertures located at the levels to be determined in combination. Since the individual effects on focusing characteristics are additive, the equivalent aperture diameter of the main lens for the center electron beam can be enlarged so that the focusing characteristics of the center electron beam can match those of the side electron beams without difficulty.

In the description of the foregoing embodiments, both the center electron beam apertures 93*a* and 94*a* and the side electron beam apertures 93*b* and 94*b* are not circular, e.g., they are elliptical. However, it is unnecessary for all of the apertures to non-circular. For example, any of the electron beam aperture, such as the center electron beam apertures 93*a* and 94*a*, may be circular. In the foregoing embodiments, moreover, the side electron beam apertures 93*b* and 94*b* are respectively formed by cutouts in the aperture electrodes 93-1 and 94-1 and the inner wall faces of the electrodes 93 and 94. The apertures 93*b* and 94*b* may naturally be made circular or non-circular, e.g., elliptical, exclusively by the aperture electrodes 93-1 and 94-1.

In the foregoing embodiments, the focusing characteristics can be further improved by making the diameter of the center electron beam aperture smaller than that of the side electron beam apertures, as measured in the direction in which the center electron beam and the side electron beams are arrayed.

As has been described hereinbefore, according to the present invention, it is possible to provide a color cathode ray tube of high resolution in which the three electron beams can be given excellent focusing characteristics by making the focusing characteristics of the center main lens match the focusing characteristics of the side main lenses.

What is claimed is:

1. A color cathode ray tube comprising:

a vacuum envelope including a panel portion, a neck portion accommodating an electron gun, and a funnel portion connecting said panel portion and said neck portion; and aperture electrodes having apertures for passing center and side electron beams, respectively, and located in a main lens electrode for said electron gun, said main lens electrode including two opposing cylindrical electrodes having racetrack-shaped sections and racetrack-shaped openings common to said center and side electron beams at opposing ends thereof, at least one of said apertures being non-circular, wherein at least one of said aperture electrodes has its center electron beam aperture located farther than its side electron beam apertures from the opposing end of the cylindrical electrode locating said at least one aperture electrode therein.

2. A color cathode ray tube according to claim 1, wherein said non-circular electron beam aperture is elliptical.

3. A color cathode ray tube according to claim 1, wherein said center electron beam aperture has a smaller diameter than those of said side electron beam apertures, as measured in the direction in which said center electron beam and said side electron beams are arrayed.

4. A color cathode ray tube according to claim 1, wherein one of said two opposing cylindrical electrodes is a final accelerating electrode, and wherein the center electron beam aperture of said aperture electrode located in said final accelerating electrode is located farther from the opposing end of said cylindrical electrode locating said at least one aperture electrode than said side electron beam apertures are.

5. A color cathode ray tube according to claim 1, wherein one of said two opposing cylindrical electrodes is a final accelerating electrode, and wherein the center electron beam aperture of said aperture electrode located in the electrode opposing said final accelerating electrode is located farther from the opposing end of said cylindrical electrode locating said at least one aperture electrode than said side electron beam apertures are.

6. A color cathode ray tube according to claim 1, wherein the center electron beam apertures of both said aperture electrodes located in both of said two opposing cylindrical electrodes are located farther from the opposing end of said cylindrical electrode locating said at least one aperture electrode than said side electron beam apertures are.

7. A color cathode ray tube according to claim 1, wherein each of said apertures taken individually has the same size and shape on opposite faces of its aperture electrode.

8. A color cathode ray tube comprising:

a vacuum envelope including a panel portion, a neck portion accommodating an electron gun, and a funnel portion connecting said panel portion and said neck portion; and aperture electrodes having non-circular apertures for passing center and side electron beams, respectively, and located in a main lens electrode for said electron gun, said main lens electrode including two opposing cylindrical electrodes having racetrack-shaped sections and racetrack-shaped openings common to said center and side electron beams at opposing ends thereof, wherein at least one of said aperture electrodes has its center electron beam aperture located farther than its side electron beam apertures from the opposing end of the cylindrical electrode locating said at least one aperture electrode therein.

9. A color cathode ray tube according to claim 8, wherein said non-circular electron beam aperture is elliptical.

10. A color cathode ray tube according to claim 8, wherein said center electron beam aperture has a smaller diameter than those of said side electron beam apertures, as measured in the direction in which said center electron beam and said side electron beams are arrayed.

11. A color cathode ray tube according to claim 8, wherein one of said two opposing cylindrical electrodes is a final accelerating electrode.

12. A color cathode ray tube according to claim 8, wherein one of said two opposing cylindrical electrodes is a final accelerating electrode, and wherein the center electron beam aperture of said aperture electrode located in said final accelerating electrode is located farther from the opposing end of said cylindrical electrode locating said at least one aperture electrode than said side electron beam apertures are.

13. A color cathode ray tube according to claim 8, wherein one of said two opposing cylindrical electrodes is a final accelerating electrode, and wherein the center electron beam aperture of said aperture electrode located in the electrode opposing said final accelerating electrode is located farther from the opposing end of said cylindrical electrode locating said at least one aperture electrode than said side electron beam apertures are.

14. A color cathode ray tube according to claim 8, wherein the center electron beam apertures of both said aperture electrodes located in both of said two opposing cylindrical electrodes are located farther from the opposing end of said cylindrical electrode locating said at least one aperture electrode than said side electron beam apertures are.

15. A color cathode ray tube according to claim 8, wherein each of said apertures taken individually has the same size and shape on opposite faces of its aperture electrode.

16. A color cathode ray tube comprising:

electron beam generating means for generating three electron beams generally in parallel with one another toward a phosphor screen; and a main lens for focusing said three electron beams on said phosphor screen, wherein said main lens includes:

two exterior electrodes arranged to oppose each other with a spacing therebetween and having openings common to said three electron beams at opposing ends thereof; and two aperture electrodes arranged in the vicinity of the respective opposing end faces of said exterior electrodes and having an aperture enclosing only a center electron beam of said three electron beams and portions for enclosing partially the two remaining side electron beams on said center electron beam side, and wherein, in at least one of said two aperture electrodes, the plane of said aperture enclosing only said center electron beam is located farther from the opposing end of said exterior electrode locating said at least one aperture electrode than the plane of said portions enclosing partially said side electron beams are.

17. A color cathode ray tube according to claim 16, wherein said aperture enclosing only said center electron beam is circular.

18. A color cathode ray tube according to claim 16, wherein said aperture enclosing only said center electron beam is elliptical.

19. A color cathode ray tube according to claim 16, wherein said aperture enclosing only said center electron beam has a smaller diameter than a diameter of an aperture defined by said portions enclosing partially said side electron beams and by the inner walls of said exterior electrodes, as measured in the direction in which said center electron beam and said side electron beams are arrayed.

20. A color cathode ray tube according to claim 16, wherein one of said two exterior electrodes is a final accelerating electrode, and wherein the plane of said aperture of said aperture electrode located in said final accelerating electrode and enclosing said center electron beam is located farther from the opposing end of said final accelerating electrode than the plane of said portions enclosing partially said side electron beams.

21. A color cathode ray tube according to claim 16, wherein one of said two exterior electrodes is a final accelerating electrode, and wherein the plane of said aperture of said aperture electrode located in the electrode opposing said final accelerating electrode and enclosing only said center electron beam is located farther from the opposing end of the electrode opposing said final accelerating electrode than the plane of the portions enclosing partially said side electron beams.

22. A color cathode ray tube according to claim 16, wherein said center electron beam apertures of both said aperture electrodes located in both of said two opposing cylindrical electrodes are located farther from the opposing end of said cylindrical electrode locating said one aperture electrode than said side electron beam apertures are.

23. A color cathode ray tube according to claim 16, wherein each of said aperture enclosing only said center electron beam and said portions enclosing partially said side electron beams taken individually has the same size and shape on opposite faces of its aperture electrode.

* * * * *